United States Patent [19]

Dargatz

[11] 4,297,043

[45] Oct. 27, 1981

[54] IMPACT PRINTER INCLINED RIBBON SCANNER

[75] Inventor: Dayton O. Dargatz, Anaheim, Calif.

[73] Assignee: Plessey Peripheral Systems, Irvine, Calif.

[21] Appl. No.: 956,737

[22] Filed: Nov. 1, 1978

[51] Int. Cl.[3] ..... B41J 33/56

[52] U.S. Cl. ..... 400/224; 400/213.1; 400/248; 400/225; 400/232

[58] Field of Search ..... 400/213, 213.1, 216.2, 400/224, 225, 229, 232, 248

[56] References Cited

U.S. PATENT DOCUMENTS

| | | | |
|---|---|---|---|
| 1,031,541 | 7/1912 | Duncan | 400/224 X |
| 1,277,500 | 9/1918 | Stickney | 400/216.2 |
| 2,202,958 | 6/1940 | McFarland | 400/224 X |
| 2,672,092 | 3/1954 | Beattie | 101/336 |
| 2,714,850 | 8/1955 | Kistner | 101/336 X |
| 2,734,615 | 2/1956 | Van Wallendael | 400/224 |
| 2,747,718 | 5/1956 | May | 400/248 X |
| 3,286,807 | 11/1966 | Decker | 400/376 |
| 3,346,090 | 10/1967 | Goff et al. | 400/232 X |
| 3,349,885 | 10/1967 | Stuiber et al. | 400/376 |
| 3,356,199 | 12/1967 | Robinson | 400/144.3 |
| 3,384,216 | 5/1968 | Thayer | 400/144.3 |
| 3,496,547 | 2/1970 | Gorrill et al. | 400/225 X |
| 3,595,362 | 7/1971 | Wolowitz | 400/229 X |
| 3,623,587 | 11/1971 | Link | 400/375.2 |
| 3,677,486 | 7/1972 | Findlay | 400/232 X |
| 3,954,167 | 5/1976 | Kranz et al. | 400/225 X |
| 4,000,804 | 1/1977 | Zaltieri | 400/225 X |
| 4,011,934 | 3/1977 | Ploby et al. | 400/248 X |
| 4,047,607 | 9/1977 | Willcox | 400/229 X |
| 4,110,050 | 8/1978 | Wood et al. | 400/213 X |
| 4,111,293 | 9/1978 | Kockler et al. | 400/213 X |
| 4,132,486 | 1/1979 | Kwan | 400/225 X |

FOREIGN PATENT DOCUMENTS

| | | | |
|---|---|---|---|
| 912319 | 4/1946 | France | 400/213 |

OTHER PUBLICATIONS

IBM Technical Disclosure Bulletin, "Ribbon Feeding Device", Reed, vol. 2, No. 5, Feb. 1960, p. 5.

IBM Technical Disclosure Bulletin, "Ribbon Oscillating Guide Mechanism", Kirksey et al., vol. 16, No. 5, Oct. 1973, pp. 1518–1519.

IBM Technical Disclosure Bulletin, "Angled Ribbon Guide", Giallo et al., vol. 19, No. 10, Mar. 1977, pp. 3817–3818.

IBM Technical Disclosure Bulletin, "Print Ribbon", Blaskovic et al., vol. 21, No. 1, Jun. 1978, pp. 19–20.

IBM Technical Disclosure Bulletin, "Control of Ribbon Speed Relative to Print Head", Blaskovic et al., vol. 21, No. 2, Jul. 1978, pp. 448–449.

*Primary Examiner*—Ernest T. Wright, Jr.

*Attorney, Agent, or Firm*—Knobbe, Martens, Olson, Hubbard & Bear

[57] ABSTRACT

A high-speed printer, such as a daisy wheel printer, utilizes a carriage which transports a printing font, such as a daisy wheel, laterally along a print line adjacent a paper-supporting platen. An ink ribbon is supported on the machine frame rather than the printing font carriage and is positioned between the daisy wheel and the platen. This ribbon is adjusted so that, as the printing font progresses along a print line, it impacts the ribbon along the line which is slanted relative the lengthwise axis of the ribbon. When plural such slanted printing tracks are overlapped along the length of the ribbon, efficient use is made of the ribbon without incurring problems associated with a narrowed ribbon. In addition, the slanted ribbon impact line permits the ribbon to be mounted on the machine main frame rather than on the font carriage while still permitting a minimum of over-impacting on the ribbon, all while eliminating the requirement of rapid ribbon movement during carriage return.

8 Claims, 13 Drawing Figures

Fig. 1
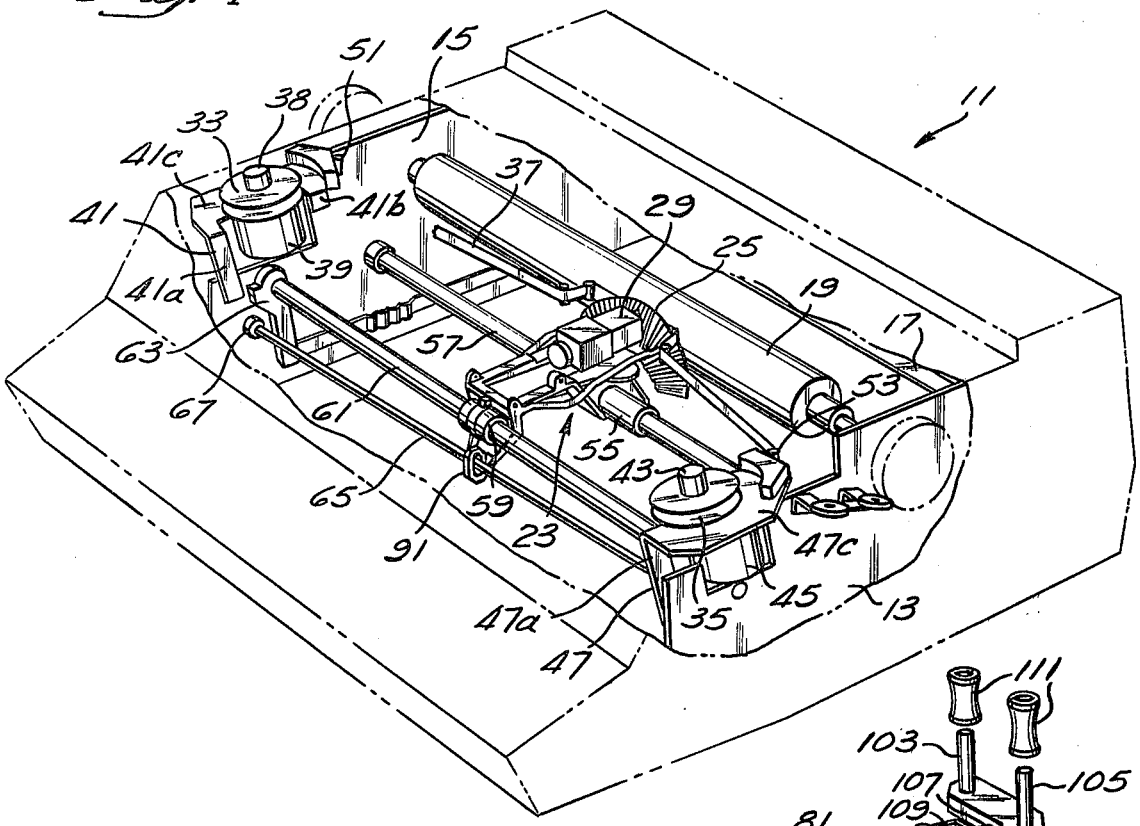
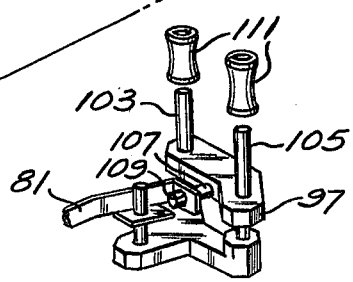
Fig. 2A
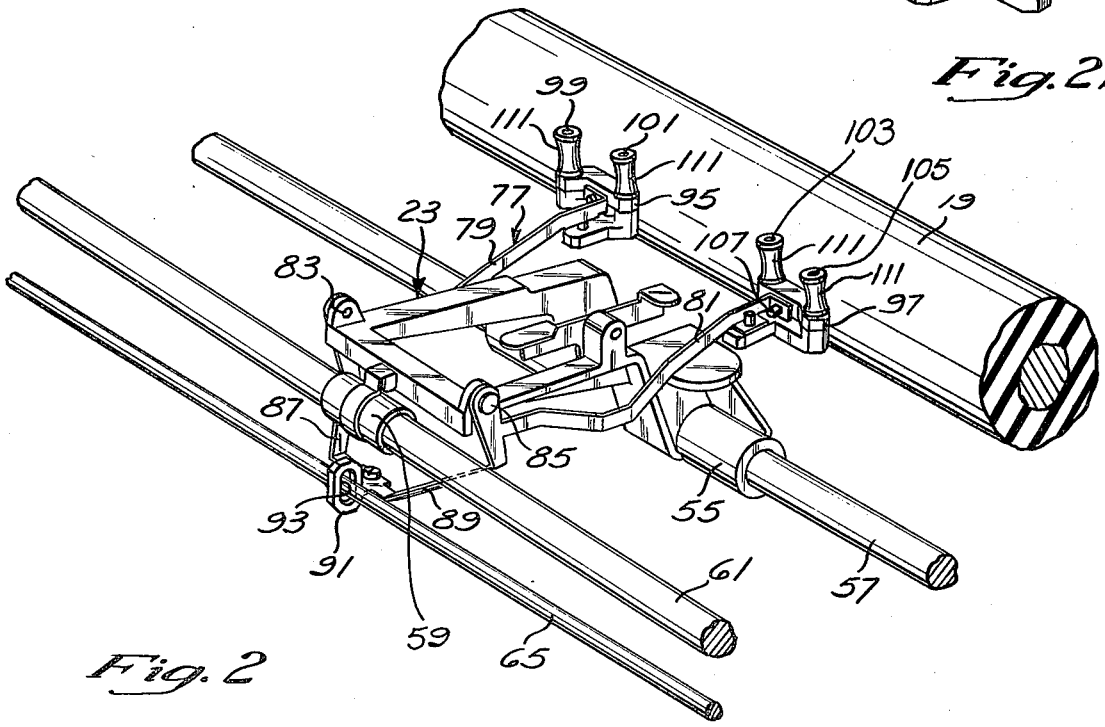
Fig. 2

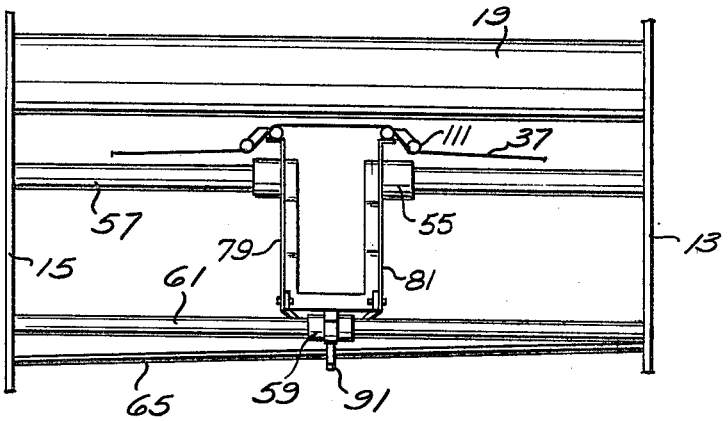
Fig. 3
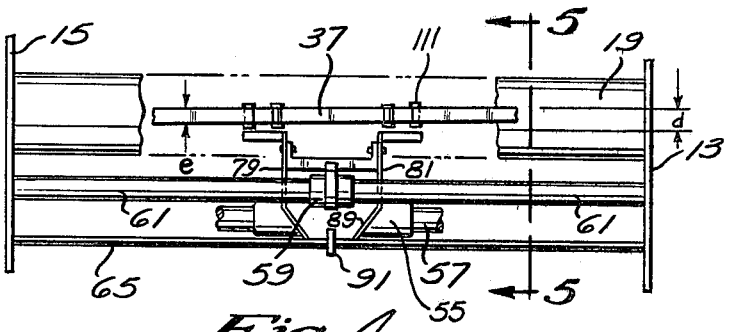
Fig. 4
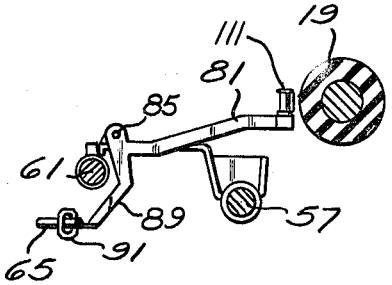
Fig. 5
Fig. 6
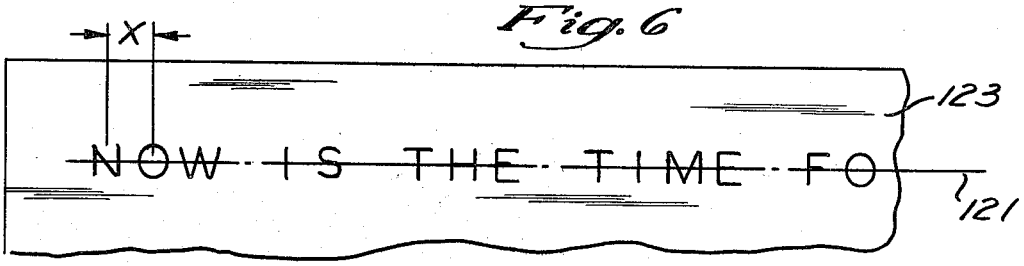
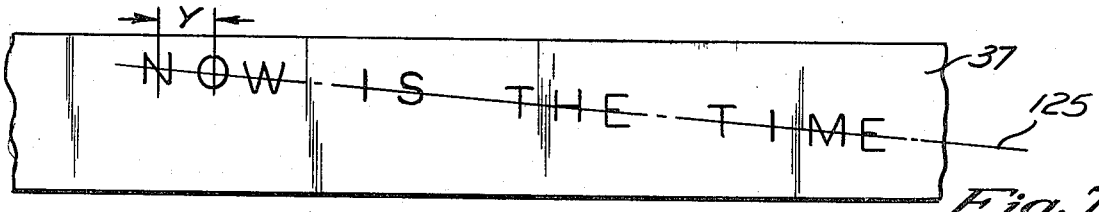
Fig. 7
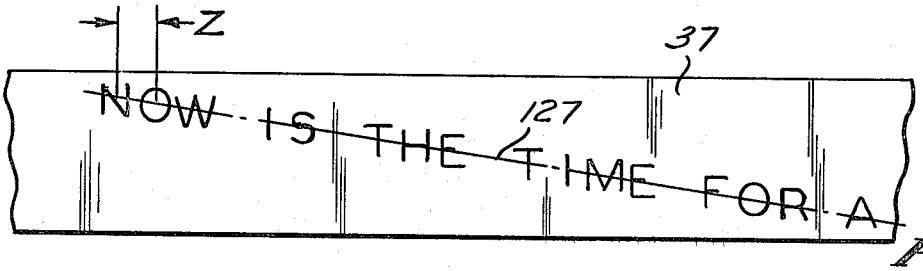
Fig. 8

Fig. 9
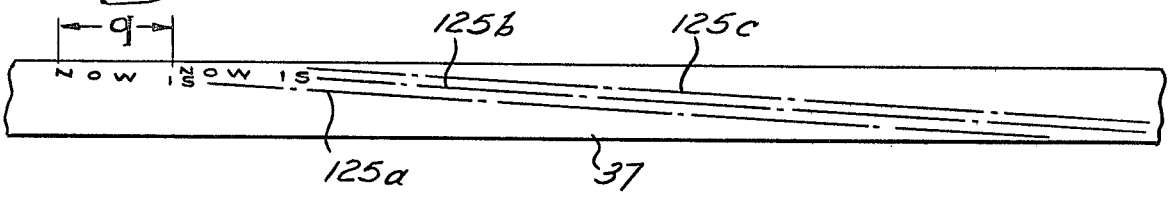
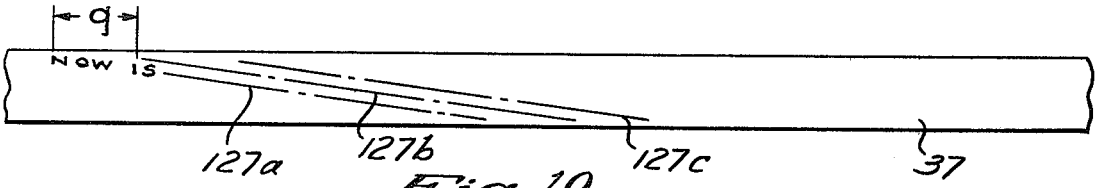
Fig. 10
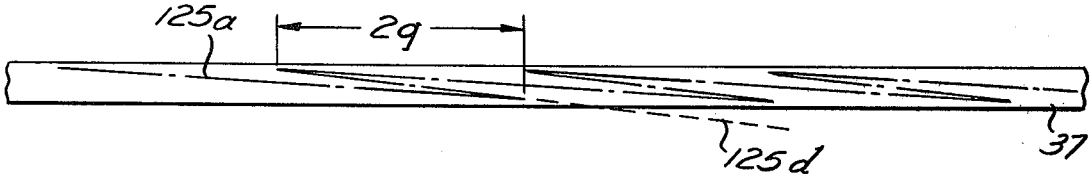
Fig. 11
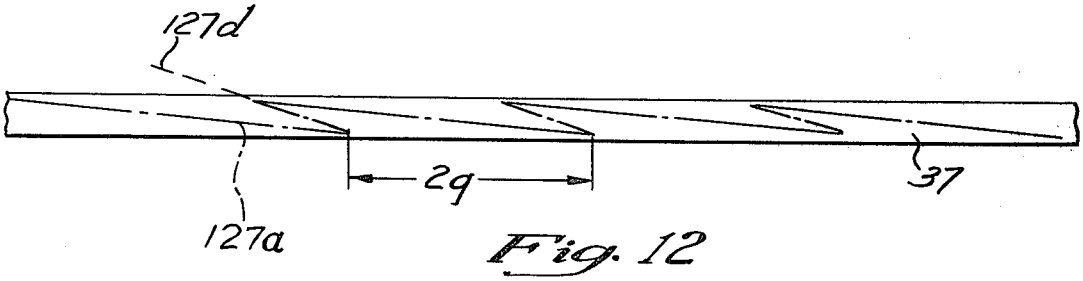
Fig. 12

IMPACT PRINTER INCLINED RIBBON SCANNER

BACKGROUND OF THE INVENTION

The present invention is directed to high-speed printers and, more specifically, to the control of a printing ribbon in a moving font printer.

For many years it was common for virtually all typing and printing equipment to include a type font or group of letter impact members designed to make an impact at a fixed location in reference to the main carriage of the machine. As more and more sophisticated electronics were integrated with such printing equipment, however, the difficulty in moving a platen and its associated carriage at high speed suggested the use of a moving font machine, that is, a machine where the paper remains stationary as a line is typed, while the type font or impact mechanism strikes at different locations along the platen by moving from one side of the main machine frame toward the other. This type font and its associated carriage are considerably lighter than the platen and its associated carriage assembly, and thus more responsive to lightweight servo systems (or mechanical systems) used to advance its position.

In most applications of this type, the font carriage mechanism supports supply and take-up reels for the printing ribbon so that the ribbon can be incremented relative to the printing head without reference to the position of the printing head relative to the platen. Such a system permitted extremely high quality carbon ribbon to be used, since it eliminated the need for overlapping impacting of characters on the ribbon. In addition, with a system of this type where the ribbon need only span the width of the type font carriage, the ribbon can be made relatively narrow, so that substantially all of the ribbon surface could be utilized in a single printing impact pass.

While it is, of course, advantageous to reduce the weight of the moving type font carriage to the greatest extent possible, the prior art has not provided a satisfactory means for removing the printing ribbon, supply reel and take-up reel, and associated drive motors from the type font carriage. This limitation in the prior art appears to result from a number of factors. Initially, if the ribbon is to be mounted on the machine's main frame, it must span the width of the machine so that the moving type font can index along the length of the ribbon as it progresses from one end of a typing line to the other. This requires that the supply reel be mounted on one extreme end of the typing frame and the take-up reel at the other extreme end. The ribbon stretched between these reels must be relatively strong in order to maintain its stretched position, since intermediate guides interface with the printing operation. This requires that either the thickness or the width of the ribbon be increased. Increases in the ribbon thickness reduce the printing quality and, therefore, the only apparent solution was an increase in ribbon width in order to make the ribbon strong enough to serve this purpose. Unfortunately, this increase in ribbon width, when coupled with the desire to avoid letter overstrikes on the ribbon, required that most of the ribbon's usable surface be wasted, a single pass utilizing the center portion of the ribbon exclusively.

An additional problem associated with any attempt to mount the ribbon reels on the machine's main frame is the fact that, after the printer has printed an entire line of type and the carriage is returned, assuming that the printer does not print in both directions, the ribbon motors must have, in effect, a fly back system. Such a system would move the ribbon very rapidly during carriage return to place an unused length of ribbon in front of the printer platen. Alternatively, if the printer is to operate in both a forward and reverse direction, one direction following the other, it is still necessary to have a ribbon fly-back. The fly-back in this instance must limit the speed of the machine substantially, since, after printing in one direction if overstrikes on the ribbon are to be avoided, the printing process must pause while the ribbon flies back, so that a fresh length of ribbon is present for the reverse printing operation.

As a consequence of these difficulties, the common technique in the prior art has been to mount the supply and take-up reels for the ribbon on the printing font carriage, increasing the size and weight of the servo system a sufficient extent to drive the carriage with this additional weight at the required speed. Such increases in the size of the servo (or the mechanical system in a mechanical machine) of necessity increases the cost, reduces the reliability and limit to a practical extent the speed at which the machine can operate.

SUMMARY OF THE INVENTION

The present invention alleviates these problems associated with the prior art by providing a ribbon which extends between supply and take-up reels mounted on the main printer frame, which permits utilization of the entire printing surface of a wide, strong ribbon and which at the same time eliminates or very substantially reduces the number of printing overstrikes on the ribbon, depending upon the typing mode.

These advantageous features provided by the present invention are accomplished by vertically tilting the ribbon relative to the line of printing of the printer. Thus, in the preferred embodiment, one of the supply and take-up reels is mounted at a higher vertical position on the machine's main frame than is the other reel. The printing ribbon, stretched between these reels, thus has a higher vertical position relative to the axis of the platen as well as the typing line on one end of the machine than on the other. The angle of this ribbon slant is selected so that the printer impacts on the top of the ribbon at one extreme of carriage movement and at the bottom of the ribbon at the other extreme of carriage movement printing in a slant relative the ribbon axis between these extremes. It has been found that, using this arrangement, it is possible to impact a successive series of diagonal imprints on the printer ribbon while printing a normal printing line on the paper. The successive diagonal impact lines on the ribbon are provided by a relatively slow, but continuous, movement of the printer ribbon during the printing operation. Thus, for example, if the printer ribbon advances by a distance equivalent to approximately five characters as the printer advances by approximately one hundred characters, when the printer carriage returns (assuming that reverse typing is not utilized), the printer will next impact a diagonal line along the ribbon which is just slightly off-set from the original diagonal line. The entire ribbon surface may be utilized in successive diagonal printing passes, allowing the relatively wide ribbon to be economically used but still avoiding substantial overprinting on the ribbon which would prohibit use of high-quality, but inexpensive, carbon ribbons.

Even when used with a dual direction typing or printing machine, the present invention will allow successive diagonal impact lines on the printer ribbon with only a minimal number of overprinting impacts on the ribbon. In this case, a multiple impact ribbon may be used if printing quality is to be maintained at its highest level.

The invention, of course, permits the optimization of the carriage servo system without the additional weight of the ribbon, its reels or cartridge and the ribbon drive motor, so that the speed of the machine as well as its economy is enhanced.

BRIEF DESCRIPTION OF THE DRAWING

These and other advantages of the present invention are best understood through a reference to the drawing, in which:

FIG. 1 is a perspective view of the front of the printer incorporating the present invention, the outer covers partially cut away to show the ribbon path and ribbon position adjusting mechanism;

FIG. 2 is a perspective view of the ribbon guide mechanism mounted on the printing font carrier;

FIG. 2A is an enlarged fragmentary view of the spool movement mechanism in FIG. 2;

FIG. 3 is top plan schematic view of the guide rods and carriage mechanism showing the means for adjusting the ribbon guide of FIG. 2;

FIG. 4 is a front elevation schematic view of the elements shown in FIG. 3;

FIG. 5 is a sectional view taken along line 5—5 of FIG. 4 of the ribbon guide of FIG. 2 showing the interrelationship between the mechanism for adjusting the ribbon support members and the guide rods associated therewith;

FIGS. 6 through 8 are schematic illustrations showing the interrelationship between the letters typed on the record medium, such as paper, by the printer of FIG. 1 and the associated impact marks made on the ribbon during such printing, FIG. 6 showing the printed manuscript, FIG. 7 showing the location on the ribbon where the printing elements have impacted in a situation where the ribbon moves left across the machine frame of FIG. 1, and FIG. 8 showing the location of printing impacts similar to FIG. 7 but representative of a situation wherein the ribbon is being moved to the right across the machine frame;

FIG. 9 illustrates schematically the location of printer impacts on the ribbon when the ribbon is moving left across the machine frame and typing occurs in one direction only;

FIG. 10 is similar to FIG. 9 except that it represents the impact locations when the ribbon is moving to the right across the machine frame;

FIG. 11 is similar to FIG. 9 except that it represents the impact locations when printing occurs sequentially in both directions; and FIG. 12 is similar to FIG. 10 but represents the locations of printer impact when printing occurs sequentially in alternate directions.

DETAILED DESCRIPTION OF THE PREFERRED EMBODIMENT

Referring initially to FIG. 1, the printer 11 of the present invention is shown to comprise a main frame assembly consisting of a pair of side plates 13, 15 interconnected by plural frame cross members, such as the member 17. In typical fashion, the side plates 13, 15 support a rotatable platen 19 on which a sheet of paper (not shown) is supported for printing. In this exemplary embodiment, the sheet of paper would be positioned between the platen 19 and a carriage assembly 23. The carriage assembly 23, in turn, supports a print wheel or daisy wheel 25 which is rotated relative to the carriage assembly 23 by a motor (not shown). It will be understood by those skilled in the art that the motor rotates the daisy wheel 25 to a proper printing position selected to print a desired character, and stops the daisy wheel 25 at this desired location. A hammer assembly 29 then impacts this desired printing element and forces the printing element to impact the paper and platen 19 and an interposed ribbon 37 which will be explained below.

As can be seen from the diagram of FIG. 1, the paper and platen 19 are stationary during the printing of a particular printed line, whereas the carriage assembly 23 moves from side to side between the plates 13 and 15 to generate a line of printing on the paper. As previously mentioned, the carriage assembly 23 on a high-speed printer 11 must be rapidly moved from one print location to the next for the typing of each letter, and must be brought by a mechanical or servo system to a stop at each print location. This requires that the carriage assembly 23 be made as light as possible. In order to maintain the light weight of the carriage assembly 23, a key element of the present invention is the mounting of a supply reel 33 and take-up reel 35 for the printing ribbon 37 directly on the main frame of the printer 11, so that the carriage assembly 23 need not incorporate the additional weight of these reels 33 and 35 and their associated driving systems.

Thus, the supply reel 33 is mounted on a shaft 38 of a supply reel motor 39 which is, in turn, mounted on a bracket 41 attached to the side plate 15. Similarly, the take-up reel 35 is mounted on a shaft 43 of a take-up reel motor 45 which is, in turn, mounted on a bracket 47 attached rigidly to the side plate 13.

The mounting bracket 41 includes a pair of vertical legs 41*a* and 41*b* which support a main mounting platform 41*c* which mounts the motor 39. Similarly, the bracket 47 includes mounting leg 47*a* and a shorter leg (not shown) similar to leg 41*b* which support a main mounting platform 47*c* attached to the motor 45. The legs 41*a* and 41*b* are shorter than the comparable legs 47*a* and the remaining leg (not shown), of the bracket 47 so that the platform 41*c* is positioned vertically lower on the side plate 15 than the position of the platform 47*c* on the side plate 13. In addition, the main support platform 41*c* is bent slightly more than 90 degrees relative to the leg 41*a*, whereas the main support platform 47*c* is bent slightly less than 90 degrees relative to the leg 47*a*. This particular orientation of the brackets 41 and 47 supports the printing ribbon 37 in a slanted configuration across the front of the platen 19.

The bracket 41 additionally supports a ribbon guide 51, and a similar ribbon guide 53 is supported by the bracket 47. The guides 51 and 53 are mounted flat on the support platforms 41*c* and 47*c* and are inclined relative to the horizontal so that they guide the ribbon 37 in a slanted orientation, relative to the horizontal, between the side plates 13 and 15.

In the particular example shown in the preferred embodiment, the width of the typing ribbon 37 is one-half inch, whereas the ribbon guide 53 is positioned one-quarter inch higher on the machine frame 11 than is the guide 51. It will be understood that the motors 39 and 45, in addition to driving the ribbon 37 from the supply reel 33 onto the take-up reel 35 (or visa versa if the ribbon 37 is moved to the left), maintain tension on the ribbon 37 so that it remains relatively taut, extending along the front of the platen 19 but tilted relative thereto.

The carriage assembly 23 is journaled by a bearing 55 onto a main slide rod 57 attached at its opposite ends to the side plates 13 and 15. In a similar manner, a second journal bearing 59 supports the outboard end of the carriage assembly 23 for reciprocal movement on a secondary guide rod 61 which is also attached to the plates 13 and 15. The guide rod 61 is vertically adjustable by a lever 63 to provide for various paper thickness in a manner described in a co-pending application, Ser. No. 956,738, filed on the same day as the present application and naming John Richard Veale as inventor. This adjustment, although not forming a part of the present invention, nevertheless imposes certain requirements on the ribbon guide mechanism of the present invention as will be understood in more detail below.

Each of the guide rods 57 and 61 are horizontally aligned with the main frame, and thus the carriage assembly 23 is driven from side to side horizontally in line with the platen 19 to form a line of printing on the paper which is also aligned with the platen 19. An additional guide bar 65 is mounted at its opposite ends on the side plates 13 and 15 and is used to adjust the ribbon guides in accordance with the present invention. The guide bar 65, although aligned in a horizontal plane, is attached at a location 67 on the side plate 15 which is closer to the front of the main frame than is the point of connection of the guide rod 65 to the side plate 13.

The particular orientation of the guide rod 65 relative the guide rods 57 and 61 is shown schematically in the front elevation view of FIG. 4 and the top plan view of FIG. 3. In addition, the relative location of the ribbon 37 is shown in these same figures. Thus, as shown in FIG. 4, the ribbon 37 is inclined relative both the horizontal and guide rod 61 and the horizontal ribbon adjustment guide rod 65. This ribbon adjustment guide rod 65, however, as shown in FIG. 3, is angled or tilted in the horizontal plane relative to both of the guide rods 57 and 61 and the ribbon 37. As previously mentioned, the distance d shown in FIG. 4 representing the slant of the ribbon 37 in the preferred embodiment is one-quarter of an inch, whereas the distance e representing the width of the ribbon 37 in the preferred embodiment is one-half inch.

One of the principle features of the present invention is a ribbon guide mechanism 77 which is mounted on the carriage assembly 23 for guiding the ribbon 37. This mechanism is adjusted by the guide rod 65 to follow the slant of the ribbon 37 as the carriage assembly 23 traverses the main frame between the side plates 13 and 15. Those skilled in the art will recognize, of course, that the carriage assembly 23 is reciprocated on the guide rods 57 and 61 by means of a cable assembly (not shown) which is driven on a pulley assembly (not shown) by a motor (not shown).

The ribbon guide mechanism 77 is shown most clearly in FIGS. 2, 2A and 5. In these figures, the carriage assembly 23 is depicted without the daisy wheel 25, its associated motor, and the hammer assembly 29 so that the ribbon guide mechanism 77 may be clearly detailed. The ribbon guide mechanism 77 includes a pair of lever arms 79 and 81 which are journaled to the front end of the carriage assembly 23 at pivot points 83 and 85. From these pivot points 83, 85, the lever arms 79 and 81 extend downwardly to form a pair of bellcrank arms 87 and 89, respectively. These bellcrank arms 87 and 89 are attached to a slider 91 which may be formed, for example, of a low friction plastic material.

The slider 91 includes an oblong aperture 93 which receives the guide rod 65. The width of the oblong aperture 93 is identical to the diameter of the guide rod 65. As previously mentioned, the guide rod 61 (FIG. 1) is vertically adjustable to adjust the printing mechanism for different paper thicknesses. The length of the oblong aperture 93 accommodates this adjustment, while the width of the aperture 93 assures that there will be no substantial space in a horizontal plane between the slider 91 and guide rod 65. As previously described, particularly in reference to FIG. 3, the guide rod 65 is angled in a horizontal plane relative the main printer frame and thus rotates the lever arms 79 and 81 about the pivot points 83 and 85, respectively, as the carriage assembly 23 is moved between the end plates 13 and 15 (FIG. 1).

The ends of the lever arms 79 and 81 opposite the pivot points 83 and 85 are attached, respectively, to a pair of platforms 95 and 97. These platforms 95 and 97 each include a pair of apertures which receive a pair of posts rigidly mounted on the carriage assembly 23. Thus, the platform 95 is reciprocally mounted on posts 99 and 101, while the platform 97 is similarly reciprocally mounted on a pair of posts 103 and 105, each of the posts 99 through 105 being rigidly attached to the carriage assembly 23 by welding or other suitable means. Because the lever arms 79 and 81 rotate about the pivot points 83 and 85, whereas the platforms 95 and 97 are constrained to reciprocate in a straight line, the interconnection between these elements is made by means of a slip joint between a post, such as the post 107 attached to the platform 97, and an aperture 109 in the end of the lever arm 81 which reciprocatingly receives the post 107. Thus, as the guide rod 65 horizontally displaces the slider 91, the lever arms 79 and 81 pivot about the pivot points 83 and 85 to raise and lower the platforms 95 and 97.

Each of the posts 99 through 105 supports a ribbon roller or spool 111 used for guiding the ribbon 37 past the daisy wheel 25 (FIG. 1). In order to accommodate the slanted ribbon 37, as previously described, each of the posts 99 through 105 is slightly tilted from the vertical, so that it is aligned perpendicular to the direction of the ribbon 37 as it passes through the ribbon guide mechanism 77.

When the carriage assembly 23 is at the extreme left side of the main machine frame, that is, at the left of FIGS. 3 and 4, the guide rod 65 of FIG. 2 is displaced at its maximum distance horizontally from the journal bearing 55, and thus the platforms 95 and 97 are in their lowest position. This lowest position aligns the spool 111 on the post 99 vertically with the ribbon guide 51 (FIG. 1). When the carriage assembly 23 is reciprocated to the right side of the machine adjacent the side plate 13, the guide rod 65 is at its closest position to the journal bearing 55, which results in a raising of the platforms 95 and 97 so that the spool 111 on the post 105 is at the same height as the ribbon guide 53 of FIG. 1. It can thus be seen from this explanation that, as the carriage assembly 23 traverses from left to right across the machine frame, the ribbon guide mechanism 77 raises and lowers the spools 111 so that these spools 111 track the inclined orientation of the ribbon 37 shown in FIG. 3. In a typical fashion, this ribbon 37 is wound to the guide rollers 111 to maintain the ribbon 37 in a proper position between the daisy wheel 25 and the paper rolled on the platen 19.

The result of the inclined ribbon 37 and the vertically reciprocating ribbon guide mechanism 77 which tracks this slanted ribbon orientation during reciprocation of the carriage assembly 23 is best understood through a reference to FIGS. 6 through 8. These figures are enlarged diagramatic illustrations of the relative position of printed characters on paper 123 rolled on the platen 19 (FIG. 1) and the location of impact of the printing characters on the ribbon 37. Referring initially to FIG. 6, a normal line of printing is shown horizontally oriented along an axis 121 on a sheet of printed paper 123. As can be seen, adjacent letters, such as letters n and o, are separated by a distance x in the normal fashion, and the axis 121 is horizontal and aligned with the paper 123.

As shown in FIG. 7, the corresponding inprints of the letters on the ribbon 37 are aligned along an axis 125 which is inclined relative the ribbon 37. In a specific example, if the width of the platen 19 (FIG. 1) is ten inches and the incline of the ribbon 37, as previously described, is one-quarter inch, then the angular incline of the axis 125 of FIG. 7 relative to the axis of the ribbon 37 is that angle which has a tangent of 1/40.

For reasons which will be explained in more detail below, the motors 39 and 45 (FIG. 1) drive the ribbon 37 relative to the printer 11 relatively slowly in comparison with the movement of the carriage assembly 23 (FIG. 1) along its guide rods 57 and 61. Thus, for example, in an illustrative embodiment, when the carriage assembly 23 moves a total of fifty characters, the ribbon 37 may move the equivalent of a five character distance. If, as shown in FIG. 7, it is assumed that the carriage assembly 23 is moving to the right and the ribbon 37 is simultaneously moving to the left, this movement of the ribbon 37 will result in a distance between adjacent letter impacts, such as the impact of the letters n and o shown in FIG. 7, shown as y, which will be ten percent greater than the distance x shown in FIG. 6. Thus, the ribbon 37 will bear the imprint of letters inclined along a slanted axis 125 and spaced slightly farther apart than the letters on the paper 123.

Referring to FIG. 8, it will be seen that, in the situation where the ribbon 37, rather than moving to the left, moves to the right, that is, from the reel 33 to the reel 35 (FIG. 1), so that the carriage assembly 23 and ribbon 37 move in the same direction, the letter impacts will be spaced closer together on the ribbon 37 than they are on the paper 123. Thus, the letters shown in FIG. 8 follow an inclined axis 127 which is slightly steeper than the inclined axis 125 and are spaced by a distance z which is approximately ten percent less than the distance x of FIG. 6 if the ribbon 37 moves at ten percent of the speed of the carriage assembly 23. Because the speed of the ribbon 37 is relatively slow in comparison with the speed of the carriage assembly 23, it will be recognized that the difference in the angular slope between the axis 125 and the axis 127 is relatively slight. That is, the actual tangent of the slope angle in FIG. 7 is 0.25/11 whereas the tangent of the slope angle of the axis 127 of FIG. 8 is 0.25/9.

The advantage of the sloping inprint axes 125 and 127 along the ribbon 37 shown in FIGS. 7 and 8 is best understood through a reference to FIGS. 9 through 12. In FIG. 9, it is assumed that the ribbon 37 moves from right to left, that is, the ribbon 37 moves in accordance with FIG. 7 so that the speeds of the ribbon 37 and carriage assembly 23 are additative. On the first pass of the carriage assembly 23 along the ribbon 37, the printing process forms letter impacts as shown in FIG. 9 along the ribbon axis 125*a*. If it is assumed that the printer 11 does not print in reverse, but rather undergoes a carriage return at the end of this first printing cycle, the next motion of the carriage assembly 23 will provide printing impacts along the axis 125*b* on the ribbon 37.

The axis 125*b* is off-set from the axis 125*a* by a distance shown as q, that is, the distance which the ribbon 37 has moved during an entire reciprocation of the carriage assembly 23. In the example given above, the distance q was given as five characters. Likewise, after the transition of the carriage assembly 23 which provides the ribbon impacts along the axis 125*b*, a carriage return will result in printing along the ribbon axis 125*c* and so on. It can be seen from FIG. 9 that, although the ribbon 37 is substantially wider than the height of the individual imprint characters, the slanted orientation of the axes 125*a-c* results in substantially complete utilization of the entire surface of the ribbon 37. This is accomplished without any high-speed movement of the ribbon 37, since it is assumed in FIG. 9 that the ribbon 37 is moved continuously at a rate equivalent to ten percent of the rate of the carriage assembly 23 movement.

In addition, this is accomplished in FIG. 9 with no inprint overlap on the ribbon 37. Thus, the characters on the axis 125*a* do not overlap any of the characters along the axis 125*b* if full lines are printed, so that single inprint carbon ribbons of high quality may be used. From this figure, therefore, it can be seen that the advantages of removing the ribbon 37 and its associated reels 33 and 35 and motors 39 and 45 from the carriage assembly 23 is accomplished without degrading the strength of the ribbon 37, its total utilization, or the quality of the print. All of this results in a printer 11 which can operate at a substantially increased speed and at lower cost.

FIG. 10 is similar to FIG. 9 except that in this case, it is assumed that the ribbon 37 is moved to the right. That is, the ribbon 37 is supplied from the reel 33 and rolled onto the reel 35 (FIG. 1). This is comparable to the diagram of FIG. 8, and it will be seen that, on the first pass of the carriage assembly 23, the characters inprinted on the ribbon 37 lie along an axis 127*a*. On the next successive pass after a carriage return movement, characters are inprinted on the ribbon 37 along an axis 127*b*. Likewise, a second carriage return results in impacting on the ribbon 37 along the axis 127*c*. These axes are inclined at steeper angles than are the axes 125 of FIG. 9, as was explained previously in reference to FIG. 8.

Again, it is assumed that the ribbon 37 moves at a speed equivalent to ten percent of the speed of the carriage assembly 23 so that the distance q, that is, five characters, separates the axes 127*a* and 127*b* in a horizontal direction. It can be seen from FIG. 10 that no character overlap occurs in this mode of operation, so that substantially the entire surface area of the ribbon 37 is used and high-quality single impact ribbon may be utilized if full lines are printed.

FIGS. 11 and 12 show the result of operating the printer of FIG. 1 with the ribbon 37 moving left and right, respectively, but assuming that the printer 11 prints as the carriage assembly 23 moves in both directions. Thus, an initial line of print is generated as the carriage assembly 23 moves from left to right (FIG. 11), and the next successive line of type is produced as the carriage assembly 23 returns from right to left, so that no carriage return or fly-back motion is utilized.

This type of printing is generally utilized as a computer output technique and substantially reduces typing time, since the carriage return time is eliminated from the process. As can be seen from FIG. 11, with the ribbon 37 moving left so that the ribbon 37 and carriage speeds are additative, an initial pass occurs along an axis 125*a*, similar to the axis 125*a* of FIG. 7. As the carriage assembly 23 returns during a return printing mode, the ribbon 37 is impacted along an axis 125*d*. During this movement, the ribbon and carriage speeds are subtractive, so that the slope of the axis 125*d* is steeper than the slope of the axis 125*a*. In addition, because the axes 125*a* and 125*d* return to the bottom of the ribbon 37 after two complete typing cycles, the distance between adjacent impact axes at the bottom of the ribbon 37 is shown to be 2*q*, that is, twice the distance q which separates adjacent axes in FIGS. 9 and 10.

It will also be recognized on an inspection of FIG. 11 and FIG. 12 (to be described below) that at the intersection of adjacent axes, for example, where axis 125*a* intersects axis 125*d*, some printing overlap will occur. It is therefore advantageous in using the dual direction carriage printing technique to use a ribbon 37 which will provide high-quality printing with overlap impacting. It should be noted, however, that such overlap impacting only occurs near the intersection of adjacent axes and that most of the printing remains on a single impact basis.

FIG. 12 is similar to FIG. 11 except that it assumes that the ribbon 37 is moving right, so that when the carriage assembly 23 moves left the speeds are additative but when the carriage assembly 23 moves to the right the speeds are subtractive. This results in an impact axis 127*a* similar to that of FIG. 10 and axis 127*d* which intersects axis 127*a* at the lower margin of the ribbon 37. As in the case of FIG. 11, the distance separating adjacent axes at the lower edge and the upper edge of the ribbon 37 is 2q, where q is the distance which the ribbon 37 moves during a single unidirectional motion of the carriage assembly 23.

Those skilled in the art will recognize that the carriage assembly 23 need not always type a full line before the carriage return. When a carriage return occurs before a full line is typed, impact overlap may occur, even in the unidirectional printing mode of FIGS. 9 and 10, and in this case a multiple impact ribbon 37 should be used.

What is claimed is:

1. An impact printer comprising:

a frame;

guide means mounted on said frame, comprising: primary guide means; and secondary guide means obliquely disposed with respect to said primary guide means;

a carriage supporting a print head, said carriage movably mounted on said guide means for reciprocation along a printing line;

a ribbon supported on said carriage; and means in communication with said secondary guide means for adjusting the position of said ribbon relative to said print head so that said printing line is not parallel to the longitudinal axis of said ribbon.

2. The impact printer of claim 1 wherein said adjusting means comprises:

follower means rotatably mounted on said carriage; and ribbon guide means for supporting said ribbon in continuously varying positions along an axis perpendicular to said printing line in response to the location of said carriage along said secondary guide means.

3. The impact printer of claim 2 wherein said ribbon guide means reciprocates horizontally with respect to said follower means in a direction perpendicular to said printing line to translate the rotational movement of said follower means into substantially vertical movement.

4. An impact printer, as defined in claim 1, additionally comprising means for driving said ribbon along its axis relative to said frame at a substantially uniform speed.

5. An impact printer, as defined in claim 4, wherein said substantially uniform speed is substantially lower than the speed of reciprocation of said carriage along said printing line.

6. An impact printer, comprising:

a frame;

guide means mounted on said frame;

a carriage supporting a print head, said carriage movably mounted on said guide means for reciprocation along a printing line;

a ribbon supported on said carriage;

a rod disposed on said frame so as to be oblique with respect to said guide means; and means responsive to the obliqueness of said rod for adjusting the position of said ribbon relative to said print head so that said printing line is not parallel to the longitudinal axis of said ribbon.

7. The printer of claim 6 wherein said adjusting means comprises:

follower means in communication with said rod; and means for translating the movement of said follower means into substantially vertical movement of said ribbon.

8. An impact printer, comprising:

a frame;

guide means mounted on said frame;

a carriage supporting a print head and movably mounted on said guide means for reciprocation along a printing line;

a ribbon supported on said carriage;

an elongate camming surface mounted across said frame so as to be inclined with said guide means; and means responsive to said camming surface for adjusting the position of said ribbon relative to said print head so that said printing line is not parallel to the longitudinal axis of said ribbon.

* * * * *